US010041228B2

(12) United States Patent
Ueda

(10) Patent No.: US 10,041,228 B2
(45) Date of Patent: Aug. 7, 2018

(54) CONSTRUCTION MACHINE

(71) Applicant: KOBELCO CONSTRUCTION MACHINERY CO., LTD., Hiroshima-shi (JP)

(72) Inventor: Koji Ueda, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 610 days.

(21) Appl. No.: 14/442,814

(22) PCT Filed: Nov. 19, 2013

(86) PCT No.: PCT/JP2013/006798
§ 371 (c)(1),
(2) Date: May 14, 2015

(87) PCT Pub. No.: WO2014/091684
PCT Pub. Date: Jun. 19, 2014

(65) Prior Publication Data

US 2015/0299987 A1 Oct. 22, 2015

(30) Foreign Application Priority Data

Dec. 13, 2012 (JP) ..... 2012-272215

(51) Int. Cl.
*E02F 9/22* (2006.01)
*E02F 3/32* (2006.01)
(Continued)

(52) U.S. Cl.
CPC ..... *E02F 9/2228* (2013.01); *E02F 3/30* (2013.01); *E02F 3/32* (2013.01); *E02F 9/226* (2013.01);
(Continued)

(58) Field of Classification Search
CPC ..... F15B 2211/46; F15B 2211/8609; F15B 2211/45; F15B 2211/50545;
(Continued)

(56) References Cited

U.S. PATENT DOCUMENTS 5,571,226 A 11/1996 Kobayashi
5,784,883 A * 7/1998 Ohkura ..... B60W 10/06 60/327
(Continued)

FOREIGN PATENT DOCUMENTS

CN 1676785 A 10/2005
EP 0 648 900 A2 4/1995
(Continued)

OTHER PUBLICATIONS

JP 3113500 B2 machine translation to English from JPO. 2000.*
(Continued)

*Primary Examiner* — Thomas E Lazo
*Assistant Examiner* — Michael Quandt
(74) *Attorney, Agent, or Firm* — Oblon, McClelland, Maier & Neustadt, L.L.P.

(57) ABSTRACT

A construction machine includes: a lower traveling body; an upper slewing body; a front attachment; a plurality of hydraulic actuators including traveling motors; hydraulic pumps; a plurality of control valves for the hydraulic actuators; a plurality of operation units for the control valves; traveling operation detectors that detect operations for the operation units for the traveling motors of the operation units; a back-pressure compensation valve generating back pressure in a return pipe line connecting each of the control valves and a tank and having a setting pressure switchable between low and high pressure setting values; and a back-pressure control section performing a back-pressure lowering control of making the setting pressure of the back-
(Continued)

pressure compensation valve be the low pressure setting value when traveling operation amounts in the traveling operation units are large.

8 Claims, 4 Drawing Sheets

(51) Int. Cl.
*F15B 11/16* (2006.01)
*F15B 11/028* (2006.01)
*E02F 3/30* (2006.01)
*F15B 11/044* (2006.01)

(52) U.S. Cl.
CPC ..... *E02F 9/2282* (2013.01); *E02F 9/2285* (2013.01); *E02F 9/2292* (2013.01); *E02F 9/2296* (2013.01); *F15B 11/028* (2013.01); *F15B 11/16* (2013.01); *F15B 11/044* (2013.01); *F15B 2211/20576* (2013.01); *F15B 2211/45* (2013.01); *F15B 2211/50545* (2013.01); *F15B 2211/5156* (2013.01); *F15B 2211/526* (2013.01); *F15B 2211/555* (2013.01); *F15B 2211/6346* (2013.01); *F15B 2211/665* (2013.01); *F15B 2211/6653* (2013.01); *F15B 2211/7058* (2013.01); *F15B 2211/7135* (2013.01); *F15B 2211/8609* (2013.01)

(58) Field of Classification Search
CPC ..... F15B 2211/555; F15B 2211/5156; F15B 11/044; F15B 11/028
See application file for complete search history.

(56) References Cited

U.S. PATENT DOCUMENTS

| | | | | |
|---|---|---|---|---|
| 5,950,430 | A * | 9/1999 | Tohji | E02F 9/123 60/426 |
| 6,112,521 | A | 9/2000 | Hayashi et al. | |
| 2005/0229594 | A1 | 10/2005 | Nanjo et al. | |
| 2006/0083622 | A1 | 4/2006 | Tatsuno et al. | |
| 2012/0047883 | A1 * | 3/2012 | Kamiya | E02F 9/2066 60/311 |
| 2014/0007565 | A1 | 1/2014 | Yamashita et al. | |
| 2014/0013752 | A1 | 1/2014 | Komiyama et al. | |
| 2014/0013753 | A1 | 1/2014 | Ueda et al. | |
| 2014/0044514 | A1 | 2/2014 | Kamimura | |
| 2014/0331664 | A1 | 11/2014 | Kamimura | |

FOREIGN PATENT DOCUMENTS

| | | | |
|---|---|---|---|
| EP | 1 580 466 | A1 | 9/2005 |
| JP | 7 180190 | | 7/1995 |
| JP | 3113500 | B2 * | 11/2000 |
| JP | 2003 120603 | | 4/2003 |
| JP | 2012-233352 | A | 11/2012 |

OTHER PUBLICATIONS

JP2003120603A machine translation to English from espacenet. 2003.*

Extended European Search Report dated Jan. 11, 2016 in Patent Application 13861615.6.

International Search Report dated Feb. 25, 2014 in PCT/JP2013/006798 Filed Nov. 19, 2013.

* cited by examiner

CONSTRUCTION MACHINE

TECHNICAL FIELD

The present invention relates to a traveling construction machine, such as a hydraulic shovel, provided with a lower traveling body including left and right traveling units to be driven to travel.

BACKGROUND ART

There will be explained an example of a hydraulic shovel according to related art, with reference to FIG. 4.

The hydraulic shovel includes a crawler type lower traveling body 1; an upper slewing body 2 disposed thereon so as to be capable of being slewed around axis X perpendicular to a ground surface; a cabin C disposed on the upper slewing body 2 as a control room; and a front attachment AT attached to the upper slewing body 2. The front attachment AT is used to perform for example an excavation, including a boom 3 so as to be able to be raised and lowered; an arm 4 mounted on a distal end of the boom 3; a bucket 5 mounted on a distal end of the arm 4; and respective hydraulic actuators for operating them, namely, a boom cylinder 6, an arm cylinder 7, and a bucket cylinder 8. The lower traveling body 1 includes crawler type left and right traveling units 9, both of which are driven by traveling motors (not shown) that are traveling hydraulic motors.

The hydraulic shovel also includes a slewing motor (not shown) that is a hydraulic actuator for slewing the upper slewing body 2; a hydraulic pump for supply hydraulic oil to the hydraulic actuators; and a plurality of control valves disposed between the hydraulic pump and respective hydraulic actuators, each of the hydraulic actuators is driven by the hydraulic oil supplied through the control valves. Each of the control valves is for example a pilot controlled selector valve and is operated by a remote control valve.

In the hydraulic excavator, when a real speed of the hydraulic actuator becomes greater than the speed corresponding to a flow rate from the hydraulic pump, for example, when the slewing motor or the traveling motor is braked, there will be a possibility of cavitation. As a conventional means for preventing cavitation from occurring, provided is a back-pressure compensation valve in a return pipe line interconnecting each of the control valves and a tank. The back-pressure compensation valve generates back pressure to prevent cavitation from occurring.

FIG. 5 schematically shows a conventional back-pressure system. The back-pressure system includes a hydraulic pump 50; a hydraulic actuator exemplified as a hydraulic motor shown in FIG. 5; a control valve 54; a return pipe line 56 connecting the control valve 54 to a tank T; and a back-pressure compensation valve 58 disposed in the return pipe line 56. The back-pressure compensation valve 58 is generally constituted of a fixed type having a fixed setting pressure, adapted to generate back pressure corresponding to the setting pressure.

On the other hand, Patent Literature 1 discloses a technique with use of a variable back-pressure compensation valve having a variable setting pressure. According to this technique, the cavitation protection function of the back-pressure compensation valve is secured by setting the setting pressure of the variable back-pressure compensation valve to a high pressure when a machine is slewed or travels, while a power loss is allowed to be decreased by setting the setting pressure of the variable back-pressure compensation valve to a low pressure when each cylinder in the front attachment is operated.

Each of the above techniques with use of the fixed back-pressure compensation valve and variable back-pressure compensation valve involves a problem of increase in power loss. The fixed back-pressure compensation valve, whose setting pressure is fixed to a constant high pressure from a point of view of prevention of cavitation, can generate unnecessarily high back pressure in a situation of no possibility of cavitation to thus involve an excessive power loss. Also the related art with use of the variable back-pressure compensation valve can involve an unnecessary power loss because the setting pressure thereof is always set to a high pressure regardless of the operation amount when the machine is being traveling. Specifically, in actual, the cavitation can be caused under the condition of low traveling operation amount such as a case where the machine is slowly traveled on a downhill; meanwhile, when the machine is being traveled at a high speed, for example, by full operation of the traveling remote control valve, hydraulic oil is introduced into the traveling motors at a great flow rate to thus increase the circuit pressure loss and to thereby generate back pressure enough to lower the possibility of cavitation. Therefore, the related art where the setting pressure of the back-pressure compensation valve is unconditionally set to a high pressure when the machine is being traveling also involves the problem of generating unnecessary backpressure, when the machine is being traveled at a high speed, to thus increase power loss.

CITATION LIST

Patent Literature

Patent Literature 1: Japanese Unexamined Patent Publication No. H7-180190

SUMMARY OF INVENTION

An object of the present invention is to provide a construction machine capable of realizing both of prevention of cavitation from occurring and decreasing power loss. The construction machine according to the present invention includes: a lower traveling body including left and right traveling units and adapted to travel by driving the left and right traveling units; an upper slewing body disposed on the lower traveling body so as to be able to be slewed; a front attachment attached to the upper slewing body; a plurality of hydraulic actuators including a traveling motor which is a drive source of each of the left and right traveling units; a hydraulic pump as a hydraulic pressure source supplying hydraulic oil to the hydraulic actuators; a plurality of control valves adapted to operate supply of hydraulic oil from the hydraulic pump to the respective hydraulic actuators to thereby control respective operations of the hydraulic actuators individually; a plurality of operation units provided for the respective control valves, the operation units including respective operation members each being adapted to receive an operation for moving the control valve corresponding to the operation unit; a traveling operation detector that detects an operation applied to an operation member of a traveling operation unit, the traveling operation unit being one of the operation units and provided for operating the control valve corresponding to the traveling motor; a back-pressure compensation valve that generates back pressure in a return pipe line connecting each of the control valves to a tank, the back-pressure compensation valve having a setting pressure switchable between a lower pressure setting value and a higher pressure setting value; and a back-pressure control section configured to perform a back-pressure lowering control of making the setting pressure of the back-pressure compensation valve be the low pressure setting value when a traveling operation amount is equal to or greater than a preset value, the traveling operation amount being an amount of the operation applied to the operation member of the traveling operation unit.

DESCRIPTION OF EMBODIMENTS

Next, with reference to the accompanying drawings, embodiments according to the present invention will be described. The following embodiment of the present invention is based on the hydraulic shovel shown in FIG. 4.

Figure 1:
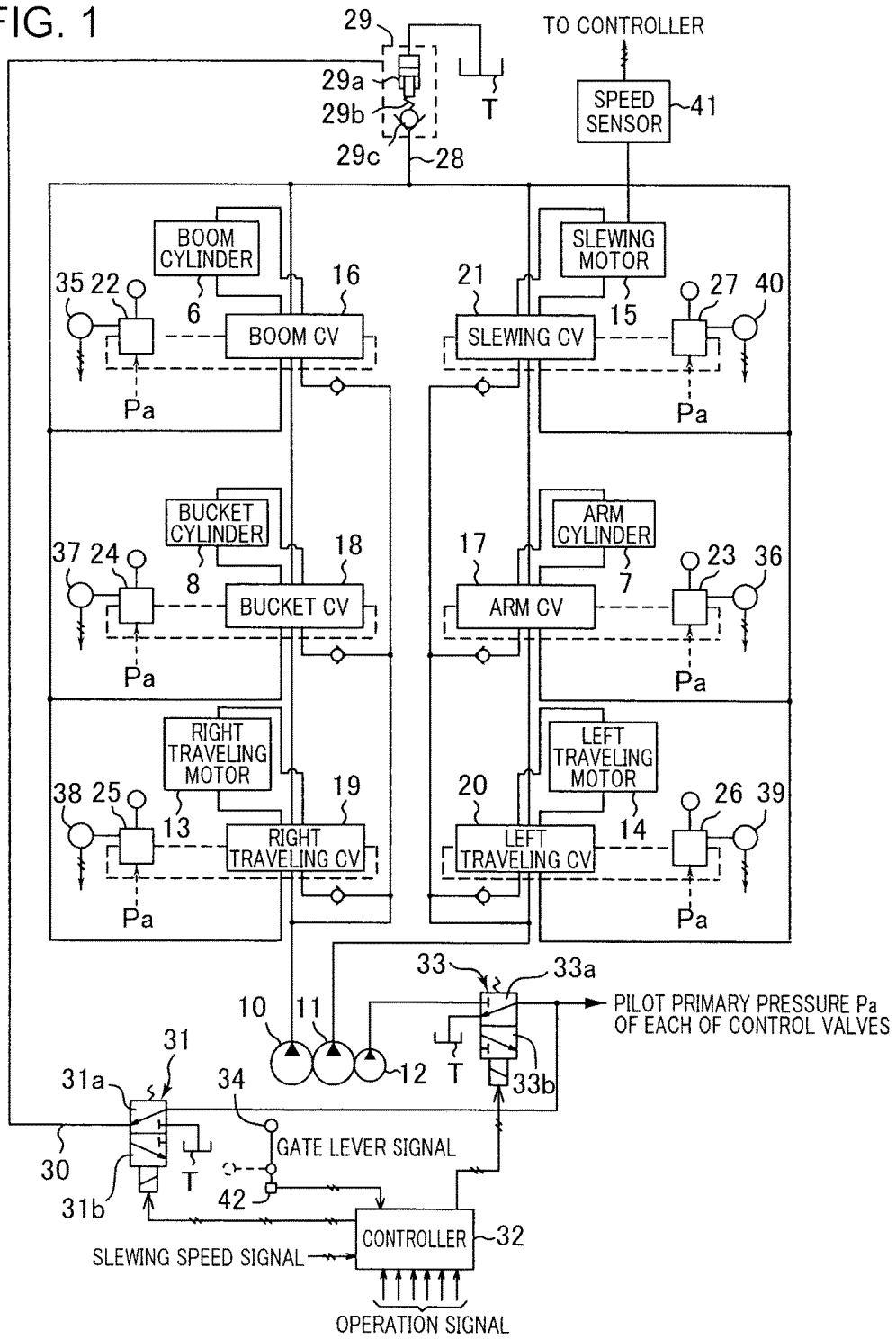
FIG. 1 is a schematic diagram showing a hydraulic circuit of a construction machine according to an embodiment of the present invention.
Figure 4:
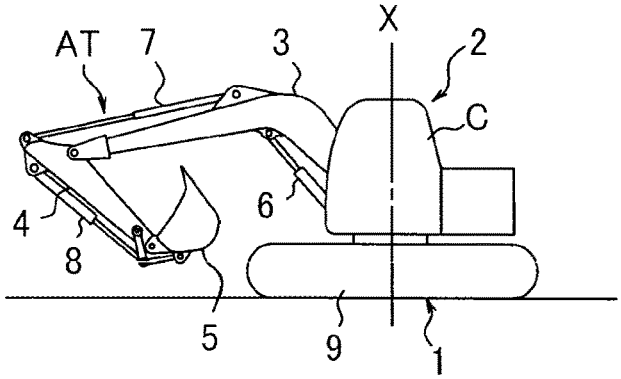
FIG. 4 (PRIOR ART)
FIG. 4 is a side view showing an outline of a whole of a hydraulic shovel.
Figure 5:
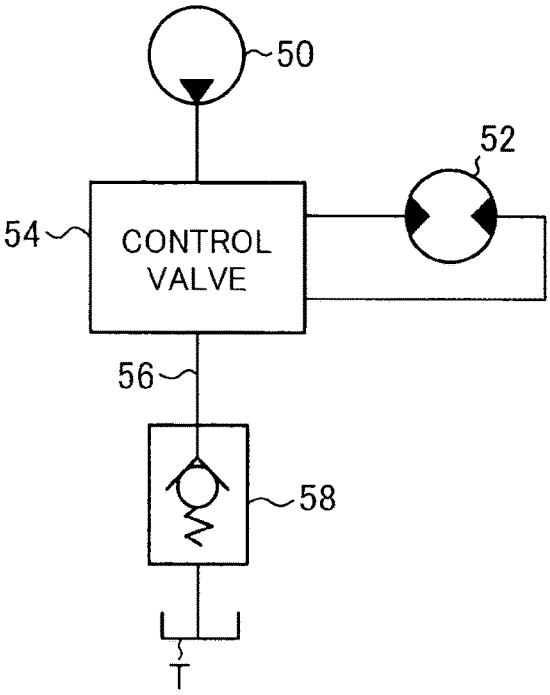
FIG. 5 (PRIOR ART)
FIG. 5 is a schematic circuit diagram showing an example of a backpressure system of a conventional hydraulic shovel.

The hydraulic shovel according to the present invention includes an engine and a hydraulic circuit shown in FIG. 1, in addition to the structural elements shown in FIG. 4. The hydraulic circuit includes first and second hydraulic pumps 10 and 11 each being a variable displacement one driven by the engine; a pilot pump 12 as a pilot pressure source; a right traveling motor 13 and a left traveling motor 14 each being formed of a hydraulic motor; a slewing motor 15 that is a hydraulic actuator for slewing the upper slewing body 2 shown in FIG. 4; a boom control valve 16 for controlling the operation of the boom cylinder 6; an arm control valve 17 for controlling the operation of the arm cylinder 7; a bucket control valve 18 for controlling the operation of the bucket cylinder 8; a right traveling control valve 19 for controlling the operation of the right traveling motor 13; a left traveling control valve 20 for controlling the operation of the left traveling motor 14; a slewing control valve 21 for controlling the operation of the slewing motor 15; and a tank T. Hydraulic oil discharged from the first pump 10 is supplied to the boom cylinder 6, the bucket cylinder 8, and the right traveling motor 13 through the control valves 16, 18, and 19, respectively, and the control valves 16, 18, and 19 are operated to control respective supplies to the boom cylinder 6, the bucket cylinder 8, and the right traveling motor 13 through the control valves 16. Likewise, hydraulic oil discharged from the second pump 11 is supplied to the arm cylinder 7, the left traveling motor 14, and the slewing motor 15 through the control valves 17, 20, and 21, respectively, and the control valves 17, 20, and 21 are operated to control respective supplies to the arm cylinder 7, the left traveling motor 14, and the slewing motor 15.

Hereinafter, respective operations applied to working hydraulic actuators for actuating a front attachment AT, namely the boom cylinder 6, the arm cylinder 7, and the bucket cylinder 8 in FIG. 4, are referred to as the "working operations"; operations applied to the traveling motors 13 and 14 are referred to as the "traveling operations"; and an operation applied to the slewing motor 15 is referred to as the "slewing operation."

The hydraulic circuit further includes remote control valves 22 to 27 that are operation units provided for the control valves 16 to 21, respectively. Each of the control valves 16 to 21 comprises a pilot controlled selector valve with a pair of pilot ports. The remote control valves 22 to 27 are disposed between the pilot pump 12 and the pilot ports of respective control valves 16 to 21 corresponding to the remote control valves 22 to 27, respectively. Each of the remote control valves 22 to 27 includes an operation lever that is an operation member receiving an operation to move the corresponding control valve, adapted to cause pilot primary pressure to be supplied to the pilot port of the control valve corresponding to the operation.

The hydraulic circuit further includes a return pipe line 28 collectively connecting respective exit sides of the control valves 16 to 21 to the tank T; a back-pressure compensation valve 29 that causes back pressure in the return pipe line 28; a pilot pipe line 30; a back-pressure selector valve 31; a hydraulic lock valve 33; and a controller 32.

The back-pressure compensation valve 29 is a pilot-pressure type control valve having a setting pressure switchable between a higher pressure setting value which is relatively high and a lower pressure setting value which is relatively low, depending on whether pilot pressure is supplied or shut off. Specifically, the back-pressure compensation valve 29 includes a poppet 29*c* forming a check valve that checks a back flow of hydraulic oil that flows from the tank T to the control valves 16 to 21; a piston 29*a* that applies valve closing force to the poppet 29*c*; and a spring 29*b* disposed between the piston 29*a* and the poppet 29*c*. The setting pressure becomes the higher pressure setting value when the pilot pressure is supplied to the piston 29*a* and becomes the lower pressure setting value when the pilot pressure is shut off. Making the setting pressure of the back-pressure compensation valve 29 be the high pressure setting value enables high back pressure to be caused to thereby secure the cavitation protection function of the back-pressure compensation valve 29; meanwhile, making the setting pressure be the low pressure setting value reduces the back pressure to thereby allow the power loss to be decreased.

The pilot pipe line 30 is a pipe line branched off from the middle of a pilot line leading from the pilot pump 12 to each of the control valves and reaching the back-pressure compensation valve 29, in order to introduce a pilot pressure into the back-pressure compensation valve 29. The back-pressure selector valve 31 is disposed in the middle of the pilot pipe line 30 to switch the setting pressure of the back-pressure compensation valve 29. The back-pressure selector valve 31 is a solenoid-operated selector valve adapted to be switched, by the signal input from the controller 32, between a pilot pressure supply position 31*a* for opening the pilot pipe line 30 to supply the pilot pressure to the back-pressure compensation valve 29 and a pilot pressure shut-off position 31*b* for shutting off the pilot pipe line 30 and bringing the back-pressure compensation valve 29 into communication with the tank T, corresponding to a signal received from the controller 32. Specifically, the back-pressure selector valve 31 is kept at the pilot pressure supply position 31*a* when no command signal is input thereto from the controller 32; the back-pressure selector valve 31 is shifted to the back-pressure selector valve 31 when the command signal is input.

The hydraulic lock valve 33 is disposed in the pilot pipe line 30 and upstream of the position at which the pilot pipe line 30 is branched off from the pilot line. The inlet for the pilot pressure of the of the back-pressure selector valve 31 is therefore connected to the pilot pump 12 through the hydraulic lock valve 33.

The hydraulic lock valve 33 comprises a solenoid-operated selector valve, having a lock position 33*a* for shutting off the pilot line to thereby intercept the supply of the pilot primary pressure from the pilot pump 12 to all the remote control valves 22 to 27 and an unlock position 33*b* for opening the pilot line to allow the pilot primary pressure to be supplied to each of the remote control valves 22 to 27. When working is performed, the hydraulic lock valve 33 is set at the unlock position 33*b*; meanwhile, when a gate lever 34 provided in a cabin C in FIG. 4 so as to open and close an entrance is manipulated in an open direction, that is, when an operator is out of the machine to perform no working, the hydraulic lock valve 33 is shifted to the lock position 33*a* by the command signal from the controller 32 based on a gate lever signal that will be described later. The hydraulic lock valve 33 thus disables all the remote control valves 22 to 27 from being operated, that is, disables all the remote control valves 22 to 27 from receiving the supply of hydraulic oil and further intercepts the supply of the pilot pressure to the back-pressure compensation valve 29 to make the setting pressure thereof be the lower pressure setting value, when no working is performed.

The hydraulic shovel further includes: respective pilot pressure sensors 35 to 40 adapted to convert pilot pressures of the remote control valves 22 to 27 into electric respective signals to detect the working operation, the traveling operation, and a slewing operation; a speed sensor 41 that detects a rotation speed of the slewing motor 15, that is, a slewing speed of the upper slewing body 2; and a gate lever sensor 42 that outputs a gate lever signal when the gate lever 34 is opened. Output signals of these sensors, namely an operation detection signal, a slewing speed detection signal, and a gate lever signal, are input to the controller 32.

The controller 32 controls the hydraulic lock valve 33 based on the input gate lever signal, while controlling switching of the back-pressure selector valve 31 based on the input operation signal and the input slewing speed signal, thus causing the setting pressure of the back-pressure compensation valve 29 to be switched between the high pressure setting value and the low pressure setting value through the back-pressure selector valve 31. The controller 32 thus corresponds to a back-pressure-selector-valve operation section that performs a back-pressure lowering control of shifting the back-pressure selector valve 31 to the pilot pressure shut-off position.

Specifically, in the case of satisfying the following condition I or the following condition II, the controller 32 shifts the back-pressure selector valve 31 to the pilot pressure shut-off position 31*b* to perform the back-pressure lowering control of making the setting pressure of the back-pressure compensation valve 29 be the low pressure setting value; otherwise, the controller 32 shifts the back-pressure selector valve 31 to the pilot pressure supply position 31*a* to make the setting pressure of the back-pressure compensation valve 29 be the high pressure setting value.

Condition I: No operation is applied to each of the remote control valves 22 to 27 and the slewing of the upper slewing body 2 is stopped.

Condition II: Each of the traveling operation amounts, i.e., the amounts of respective operations applied to the traveling remote control valves 25 and 26 corresponding to the left and right traveling control valves 19 and 20, respectively, is equal or more than preset values; respective operation signals from the other remote control valves are absent; and the slewing of the upper slewing body 2 is stopped.

Figure 2:
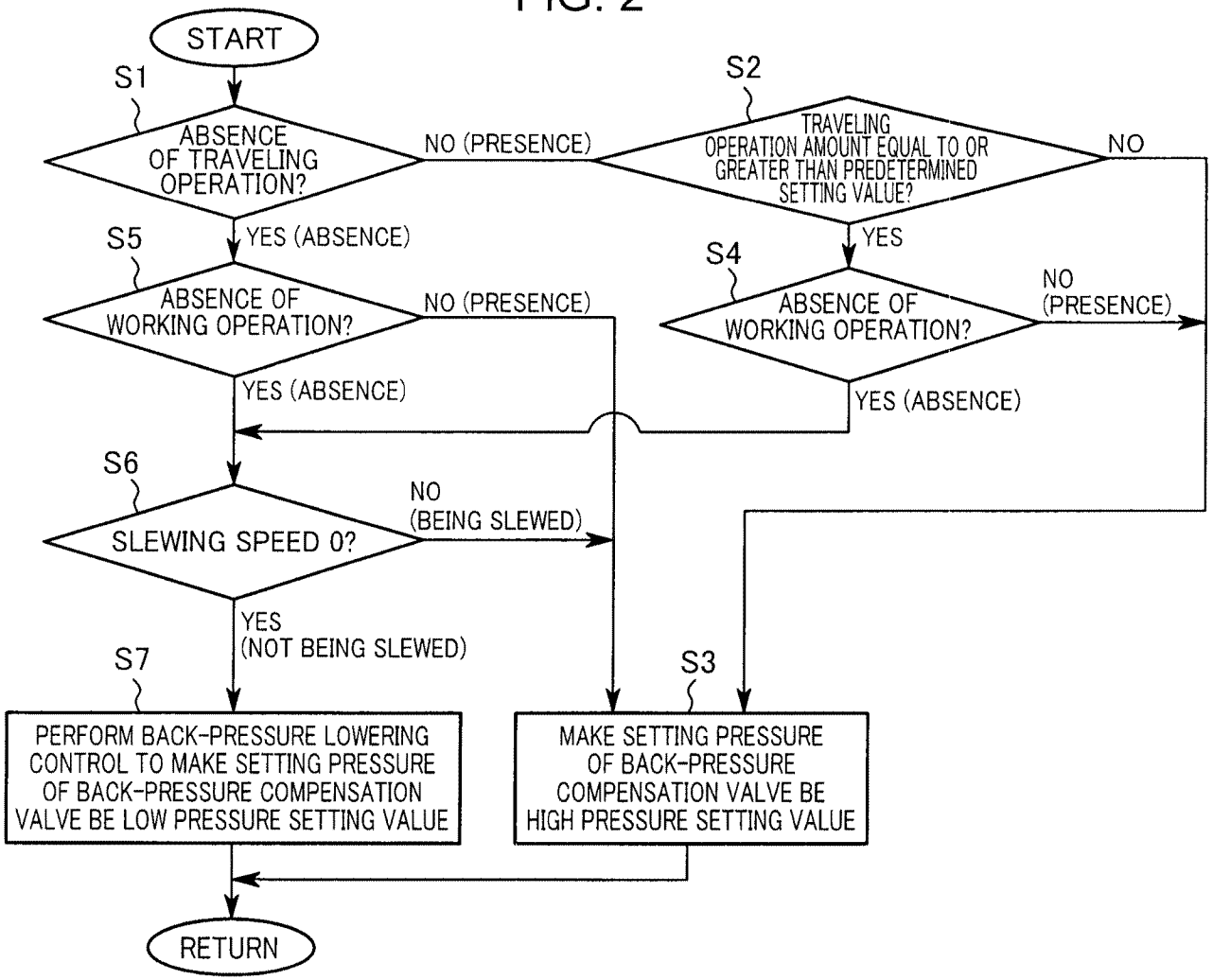
FIG. 2 is a flow chart showing a control operation performed by a controller according to the embodiment.

Next will be described in detail a specific control operation performed by the controller 32, with reference to a flow chart shown in FIG. 2.

In step S1, the controller 32 judges whether or not the traveling operation is absent. In the case of NO in step S1, that is, in the case where the traveling operation is being performed, the controller 32 judges, in step s2, whether or not the traveling operation amount is equal to or greater than a preset value. The thus described preset value for the traveling operation amount is not limited to the operation amount for full operation of the traveling remote control valves 25 and 26 but can be set as long as there is no possibility that circuit pressure loss due to a flow in the traveling motor causes cavitation. In the case of NO in step S2, that is, the traveling operation amount is less than the preset value, where the possibility of cavitation exists, the controller 32 makes the setting pressure of the back-pressure compensation valve 29 be the high pressure setting value, in step S3. In other words, the controller 32 does not perform the back-pressure lowering control.

In the case of YES in step S2, that is, in the case where the traveling operation amount is equal to or greater than the preset value, the controller 32 further judges whether or not the working operation is absent, in step S4. In the case of NO in step S4, that is, the working operation is being performed, where the possibility of cavitation exists, the controller 32 makes the setting pressure of the back-pressure compensation valve 29, in step S3, be the high pressure setting value.

In the case of YES in step S1, that is, in the case of absence of the traveling operation, the controller 32 judges, in step S5, whether or not the working operation is absent, and judges, in step S6, whether or not the slewing speed is 0, that is, the slewing of the machine is stopped. In the case of NO in each of steps S5 and S6, that is, the working operation is being performed or the machine is being slewed, where the possibility of cavitation exists, the controller 32 makes the setting pressure of the back-pressure compensation valve 29 be the high pressure setting value, in step S3. Meanwhile, in the case of YES in step S6, that is, both the traveling operation and the working operation are absent and the slewing is being stopped, where no possibility of cavitation exists, the controller 32 performs the back-pressure lowering control, in step S7. Specifically, the controller 32 shifts the back-pressure selector valve 31 shown in FIG. 1 to the pilot pressure shut-off position 31*b* to make the setting pressure of the back-pressure compensation valve 29 be the low pressure setting value. In the case of YES in step S4, that is, the traveling operation amount is equal to or greater than the preset value and the working operation is not being performed, the controller 32 makes judgment on the slewing speed, in step S6. In the case of judgment that the slewing is stopped, the controller 32 also performs the back-pressure lowering control in step S7.

Besides, the hydraulic lock valve 33 is set at the unlock position 33*b*, when the gate lever 34 is closed and the machine is therefore being operated, thereby permitting the pilot primary pressure to be supplied from the pilot pump 12 to all the remote control valves 22 to 27 and also permits the pilot pressure to be supplied to the back-pressure compensation valve 29.

As described above, when the traveling operation is being performed with the traveling operation amount equal to or greater than the preset value, that is, when the machine is traveled at a high speed while hydraulic oil flow is flowed into both the traveling motors 13 and 14 at great flow rate to cause enough back pressure by the circuit pressure loss, the controller 32 makes the setting pressure of the back-pressure compensation valve 29 be the low pressure setting value to thereby allow the power loss to be decreased; on the other hand, when the traveling operation is being performed with the traveling operation amount less than the preset value, that is, the machine is traveled at a low speed while the flow rate of the hydraulic oil in the traveling motors is so small that causing enough back pressure by circuit pressure loss cannot be expected, the controller 32 makes the setting pressure of the back-pressure compensation valve 29 be the high pressure setting value to thereby secure function of preventing cavitation from occurring during traveling on a downhill and the like. The construction machine is thus capable of causing suitable back pressure for operating amount, when traveled, thereby realizing both of cavitation prevention and reduction in power loss.

The construction machine further allows the following effects to be obtained.

(i) The back-pressure control section, including the back-pressure selector valve 31 and the controller 32 which is a back-pressure-selector-valve operation section adapted to switch the position of the back-pressure selector valve 31, can perform the switching of the setting pressure of the back-pressure compensation valve 29 between the high pressure setting value and the low pressure setting value with a simple operation of switching the position of the back-pressure selector valve 31.

(ii) The back-pressure selector valve 31, adapted to be set at the pilot pressure supply position 31*a* when the command signal from the controller 32 is not input to the back-pressure selector valve 31 and adapted to be shifted to the pilot pressure shut-off position 31*b* when the command signal is input, has no possibility of losing the back-pressure compensation function by miss-switching of the setting pressure of back-pressure compensation valve 29 due to a wire break or failure in a control system.

(iii) The hydraulic lock valve 33, adapted to shut off the back-pressure compensation valve 29 from the pilot pressure source to thereby make the setting pressure of the back-pressure compensation valve 29 be the low pressure setting value when the hydraulic lock valve 33 is shifted to the lock position 33*a*, can prevent excess back pressure from being applied to unload oil when no working is performed, thus decreasing power loss. In addition, the utilization of the hydraulic lock valve 33 deletes the requirement for a detector that detects absent of working.

(iv) Making the setting pressure of the back-pressure compensation valve 29 be the low pressure setting value when it is detected that no operation is applied to all the hydraulic actuators prevents excessive back pressure from being applied, thereby decreasing the power loss due to the back-pressure compensation valve 29.

(v) The controller 32, adapted to perform the back-pressure lowering control on condition that the slewing is stopped, in other words, adapted to make the setting pressure of the back-pressure compensation valve 29 be the high pressure setting value regardless of the traveling operation amount when the slewing is performed, can securely prevent cavitation from occurring in the slewing motor 15.

(vi) The controller 32, adapted to perform no back-pressure lowering control but make the setting pressure of the back-pressure compensation valve 29 be the high pressure setting value when a combined operation of simultaneously making both of the traveling operation and an operation for an actuator other than those for the traveling motors 13 and 14 are being performed, can make the back-pressure compensation function be so effective as to securely prevent cavitation from occurring in other actuators.

The present invention is not limited to the foregoing embodiment, but permitted to include the following embodiment.

(1) In place of making the judgment that the machine is not being slewed according to the first embodiment where the slewing stop is determined to be detected and the slewing speed sensor 41 detects the slewing speed and the detected slewing speed is 0, no slewing may be judged when the slewing operation amount detected by the pilot pressure sensor 38 is less than the preset value (0 or nearly 0) and this state continues for a predetermined period of time.

Figure 3:
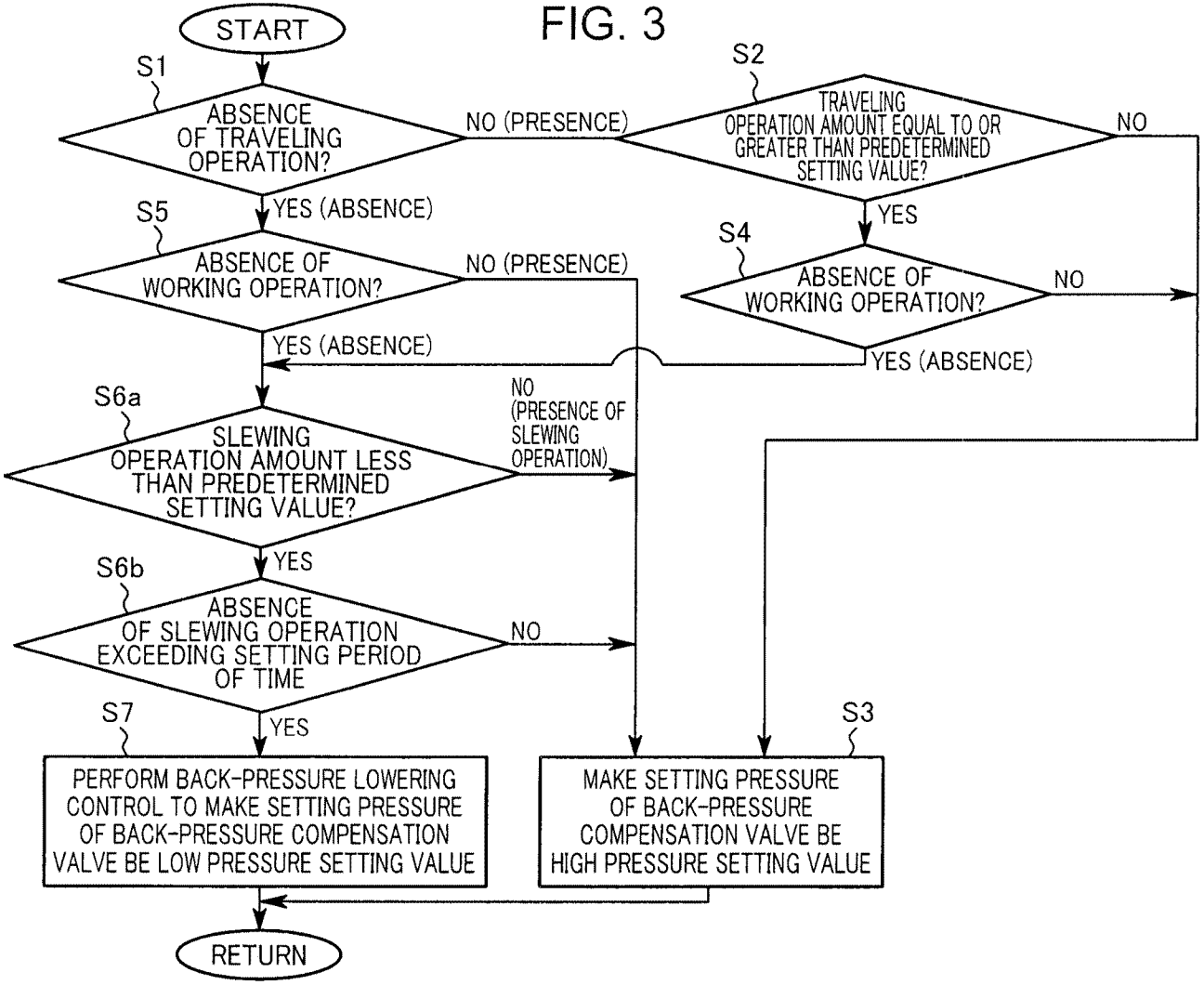
FIG. 3 is a flow chart showing another example of the control operation performed by the controller.

This embodiment will be described below with reference to a flow chart shown in FIG. 3. Instead of step S6 shown in FIG. 2, the judgment on whether or not the slewing operation amount is less than the preset value is made in step S6*a*; in the case of YES, judged is whether or not a state of slewing operation amount<preset value continues for a predetermined period of time, in step S6*b*. If the result of the judgment is YES, the state is regarded as slewing stop state and step S7 will be carried out. The rest of the process is the same as the process represented in the flow chart shown in FIG. 2.

(2) The pilot pressure of the back-pressure compensation valve 29, while being obtained by utilization of an outlet pressure of the hydraulic lock valve 33 according to the foregoing embodiment, may be directly supplied from the pilot pump 12 regardless of the operation of the hydraulic lock valve 33.

As described above, according to the present invention, provided is a construction machine capable of realizing both of cavitation prevention and reduction in a power loss. The construction machine provided by the present invention includes: a lower traveling body including left and right traveling units and adapted to travel by driving the left and right traveling units; an upper slewing body disposed on the lower traveling body so as to be able to be slewed; a front attachment attached to the upper slewing body; a plurality of hydraulic actuators including a traveling motor which is a drive source of each of the left and right traveling units; a hydraulic pump as a hydraulic pressure source supplying hydraulic oil to the hydraulic actuators; a plurality of control valves adapted to operate supply of hydraulic oil from the hydraulic pump to the respective hydraulic actuators to thereby control respective operations of the hydraulic actuators individually; a plurality of operation units provided for the respective control valves, the operation units including respective operation members each being adapted to receive an operation for moving the control valve corresponding to the operation unit; a traveling operation detector that detects an operation applied to an operation member of a traveling operation unit, the traveling operation unit being one of the operation units and provided for operating the control valve corresponding to the traveling motor; a back-pressure compensation valve that generates back pressure in a return pipe line connecting each of the control valves to a tank, the back-pressure compensation valve having a setting pressure switchable between a lower pressure setting value and a higher pressure setting value; and a back-pressure control section configured to perform a back-pressure lowering control of making the setting pressure of the back-pressure compensation valve be the low pressure setting value when a traveling operation amount is equal to or greater than a preset value, the traveling operation amount being an amount of the operation applied to the operation member of the traveling operation unit.

According to the construction machine, making the setting pressure of the back-pressure compensation valve is made be the low pressure setting value when an traveling operation with a traveling operation amount equal to or greater than the preset value is being performed, that is, when the construction machine is being traveling at a high speed while hydraulic oil flows in the traveling motors at such a high flow rate that the circuit pressure loss generates sufficient back pressure, allows power loss to be decreased. On the other hand, when a traveling operation with a traveling operation amount less than the preset value is being performed, that is, when the construction machine is being traveling at a low speed while hydraulic oil flows in the traveling motors in such a small flow rate that sufficient back pressure caused by the circuit pressure loss cannot be expected, the back-pressure compensation valve is made be the high pressure setting value to thereby allowing cavitation prevention function to be secured during traveling on a downhill and the like. The preset value for the traveling operation amount is not limited to an operation amount corresponding to the "full traveling operation" in which the traveling operation units are fully operated but permitted to be set on condition of no possibility of cavitation.

As a specific configuration of circuit, it is preferable that: the back-pressure compensation valve is a pilot-controlled selector valve whose setting pressure is shifted from the low pressure setting value to the high pressure setting value when pilot pressure is supplied from a pilot pressure source to the pilot-controlled selector valve; and the back-pressure control section includes a back-pressure selector valve disposed between the back-pressure compensation valve and the pilot pressure and having a pilot-pressure supply position for allowing the pilot pressure to be supplied from the pilot pressure source to the back-pressure compensation valve and a pilot pressure shut-off position for shutting off the supply of the pilot pressure, and a back-pressure-selector-valve operation section that performs the back-pressure lowering control by shifting the back-pressure selector valve to the pilot pressure shut-off position. This allows the switching of the setting pressure of the back-pressure selector valve between the high pressure setting value and the low pressure setting value to be performed by the simple operation of switching the position of the back-pressure selector valve.

In this case, it is preferable that the back-pressure selector valve is configured to be set at the pilot pressure supply position when no command signal is input from the back-pressure selector valve operation section and configured to be shifted to the pilot pressure shut-off position when a command signal is input. The back-pressure selector valve allows a safety-side control which gives priority to prevention of cavitation by keeping the back-pressure compensation value at the high pressure setting value when receiving no signal from the back-pressure selector valve operation section to be performed, thus deleting a possibility that the back-pressure compensation valve loses its back-pressure compensation function by mismaking the setting pressure of back-pressure compensation valve be the low pressure setting value due to a wire break or a failure in a control system.

In the case where the back-pressure control section includes a back-pressure selector valve and a back-pressure-selector-valve operation section, it is preferable that: each of the control valves is a pilot-controlled selector valve configured to be operated by pilot pressure; each of the operation units is a remote control valve configured to output the pilot pressure from the pilot pressure source in accordance with the operation applied to the operation member; and the construction machine further includes a cabin disposed on the upper slewing body as an operation room, a gate lever manipulated so as to open and close an entrance of the cabin, and a hydraulic lock valve configured to shut off all of the remote control valves from the pilot pressure source when the gate lever is opened, the hydraulic lock valve having an outlet pressure which is led to the back-pressure compensation valve via the back-pressure selector valve. While a construction machine such as a hydraulic shovel is generally designed to activate a hydraulic lock when a gate lever thereof is opened because it indicates that no working is performed, the above configuration shuts off the back-pressure compensation valve from the pilot pressure source to make the setting pressure thereof be the low pressure setting value when the hydraulic lock is activated by the hydraulic lock valve, thus preventing excess back pressure from being applied to the unload oil during no working to thereby allow the power loss to be decreased. In addition, the utilization of the hydraulic lock valve allows a detector for detecting no working to be omitted.

The construction machine according to the present invention preferably also includes a plurality of actuator operation detectors that detect respective operations of the operation units except the traveling operation units, the back-pressure control section being configured to perform the back-pressure lowering control also when no operation is applied to all the operation units including the traveling operation. The back pressure control section, making the setting pressure of the back-pressure compensation valve be the low pressure setting value when no operation applied to all the actuators is detected, prevents excessive back pressure from being applied to the unload oil to thus allow the power loss due to the back-pressure compensation valve to be decreased.

The construction machine according to the present invention preferably also includes a slewing stop detector that detects that the upper slewing body is stopped, the hydraulic actuator including a slewing motor that slews the upper slewing body, the back-pressure control section configured to perform the back-pressure lowering control on condition that stop of the upper slewing body is detected. Since cavitation is likely to occur when the upper slewing body is slewed, especially, at a reduced speed, making the setting pressure of the back-pressure compensation valve be the high pressure setting value regardless of the traveling operation amount when the upper slewing body is slewed makes it possible to more securely prevent cavitation from occurring in the slewing motor.

Specifically, it is permitted that the slewing stop detector includes a slewing speed detector that detects a slewing speed of the upper slewing body and the back-pressure control section is configured to judge that the upper slewing body is stopped when the slewing speed of the upper slewing body is 0; it is also permitted that the slewing stop detector includes a slewing operation detector that detects an operation applied to a slewing operation unit that is one of the operation unit and provided for the slewing motor and the back-pressure control section is configured to judge that the upper slewing body is stopped when an operation amount of the slewing operation unit is kept less than a preset value for a predetermined period of time. The latter configuration, requiring no slewing speed detector, is more advantageous in cost.

The construction machine according to the present invention preferably also includes, in addition to a traveling operation detector, a plurality of operation detectors that detect respective operations of the operation units except the traveling operation unit, the back-pressure control section being configured to make the setting pressure of the back-pressure compensation valve be the high pressure setting value, not only when the traveling operation amount is equal to or greater than the preset value, but also when a combined operation of simultaneously making both of the traveling operation and an operation applied to at least one of the operation units except the traveling operation unit is performed. The back-pressure control section can prevent cavitation from occurring also in actuators other than the traveling motors by performing no back-pressure lowering control, when the combined operation is performed, to keep the setting pressure of the back-pressure compensation valve at the high pressure setting value and to thereby make the back-pressure compensation function effective.

The invention claimed is:

1. A construction machine, comprising:

a lower traveling body including left and right traveling units and adapted to travel by driving the left and right traveling units;

an upper slewing body disposed on the lower traveling body so as to be able to be slewed;

a front attachment attached to the upper slewing body;

a plurality of hydraulic actuators including a traveling motor which is a drive source of each of the left and right traveling units;

a hydraulic pump as a hydraulic pressure source supplying hydraulic oil to the hydraulic actuators;

a plurality of control valves adapted to operate supply of hydraulic oil from the hydraulic pump to the respective hydraulic actuators to thereby control respective operations of the hydraulic actuators individually;

a plurality of operation units provided for the respective control valves, the operation units including respective operation members each being adapted to receive an operation for moving the control valve corresponding to the operation unit;

a traveling operation detector that detects an operation applied to an operation member of a traveling operation unit, the traveling operation unit being one of the operation units and provided for operating the control valve corresponding to the traveling motor;

a plurality of operation detectors that detect respective operations of the operation units other than said traveling operation unit;

a back-pressure compensation valve that generates back pressure in a return pipe line connecting each of the control valves to a tank, the back-pressure compensation valve having a setting pressure switchable between a lower pressure setting value and a higher pressure setting value; and a back-pressure control section configured to perform a back-pressure lowering control of making the setting pressure of the back-pressure compensation valve be the low pressure setting value in response to a traveling operation amount being equal to or greater than a preset value and no operation being applied to each of the operation units other than the traveling operation unit, and configured to make the setting pressure of the back-pressure compensation valve be the high pressure setting value not only in response to the traveling operation amount being less than the preset value but also in response to a combined operation of simultaneously making both of the traveling operation and an operation applied to at least one of the operation units other than the traveling operation unit be performed, the traveling operation amount being an amount of the operation applied to the operation member of the traveling operation unit.

2. The construction machine according to claim 1, wherein: said back-pressure compensation valve is a pilot-controlled selector valve whose setting pressure of the pilot-controlled selector valve is shifted from said low pressure setting value to said high pressure setting value when pilot pressure is supplied from a pilot pressure source; and said back-pressure control section includes a back-pressure selector valve disposed between said back-pressure compensation valve and said pilot pressure source and having a pilot pressure supply position for allowing the pilot pressure to be supplied from said pilot pressure source to said back-pressure compensation valve and a pilot pressure shut-off position for shutting off the supply of the pilot pressure, and a back-pressure-selector-valve operation section configured to perform the back-pressure lowering control by shifting said back-pressure selector valve to said pilot pressure shut-off position.

3. The construction machine according to claim 2, wherein said back-pressure selector valve is configured to be set at said pilot pressure supply position when no command signal is input from said back-pressure selector valve operation section and configured to be shifted to the pilot pressure shut-off position when the command signal is input.

4. The construction machine according to claim 2, wherein: each of the control valves is a pilot-controlled selector valve configured to be operated by pilot pressure; each of the operation units is a remote control valve configured to output the pilot pressure from the pilot pressure source in accordance with the operation applied to the operation member; and the construction machine further includes a cabin disposed on the upper slewing body as an operation room, a gate lever manipulated so as to open and close an entrance of the cabin, and a hydraulic control valve configured to shut off all of the remote control valves from the pilot pressure source when the gate lever is opened, the hydraulic lock valve having an outlet pressure which is led to the back-pressure compensation valve via the back-pressure selector valve.

5. The construction machine according to claim 1, further comprising a plurality of actuator operation detectors that detect respective operations of the operation units except said traveling operation units, wherein said back-pressure control section performs said back-pressure lowering control also when no operation is applied to all the operation units including said traveling operation unit.

6. The construction machine according to claim 1, further comprising a slewing stop detector that detects that said upper slewing body is stopped, wherein said hydraulic actuator includes a slewing motor that slews said upper slewing body, and said back-pressure control section performs said back-pressure lowering control on condition that the stop of said upper slewing body is detected.

7. The construction machine according to claim 6, wherein said slewing stop detector includes a slewing speed detector that detects a slewing speed of said upper slewing body, and said back-pressure control section is configured to judge that said upper slewing body is stopped when the slewing speed of the upper slewing body is 0.

8. The construction machine according to claim 6, wherein said slewing stop detector includes a slewing operation detector that detects an operation applied to a slewing operation unit that is one of the operation unit and provided for said slewing motor, and said back-pressure control section is configured to judge that said upper slewing body is stopped when an operation amount of said slewing operation unit is kept less than a preset value for a predetermined period of time.

* * * * *